US012492817B2

(12) United States Patent
Wells et al.

(10) Patent No.: US 12,492,817 B2
(45) Date of Patent: Dec. 9, 2025

(54) STOVE, CONTROL SYSTEM, AND METHOD FOR CONTROLLING THE SAME

(71) Applicant: A.J. WELLS & SONS LIMITED, Newport (GB)

(72) Inventors: Alexander Wells, Newport (GB); Paul Wells, Newport (GB)

(73) Assignee: A.J. Wells & Sons Limited, Newport (GB)

( * ) Notice: Subject to any disclaimer, the term of this patent is extended or adjusted under 35 U.S.C. 154(b) by 819 days.

(21) Appl. No.: 17/771,403

(22) PCT Filed: Oct. 9, 2020

(86) PCT No.: PCT/GB2020/052506
§ 371 (c)(1),
(2) Date: Apr. 22, 2022

(87) PCT Pub. No.: WO2021/079086
PCT Pub. Date: Apr. 29, 2021

(65) Prior Publication Data

US 2022/0390105 A1 Dec. 8, 2022

(30) Foreign Application Priority Data

Oct. 25, 2019 (GB) ..... 1915535

(51) Int. Cl.
*F23N 5/10* (2006.01)
*F23N 5/08* (2006.01)

(52) U.S. Cl.
CPC ..... *F23N 5/102* (2013.01); *F23N 5/082* (2013.01); *F23N 2900/05005* (2013.01)

(58) Field of Classification Search
CPC . F23N 5/102; F23N 5/082; F23N 2900/05005
(Continued)

(56) References Cited

U.S. PATENT DOCUMENTS 3,536,029 A 10/1970 Kuwayama et al.
4,163,903 A * 8/1979 Robertson ..... F23N 5/082 250/554

(Continued)

FOREIGN PATENT DOCUMENTS

CN 206771321 U 12/2017
WO 2019145854 A1 8/2019

OTHER PUBLICATIONS

International Search Report; International Patent Application No. PCT/GB2020/052506; A.J. Wells & Sons Limited; Jan. 11, 2021.

*Primary Examiner* — Vivek K Shirsat
(74) *Attorney, Agent, or Firm* — SandBright, PLLC; Robert D. Spendlove

(57) ABSTRACT

A stove (1) having a combustion chamber (2) supplied by one or more air supply paths (9, 14, 16). One or more valves (11, 15, 17) are provided for controlling airflow through the one or more air supply paths (9, 14, 16). A temperature sensor (4) is used to determine the air temperature associated with the combustion chamber (2), and a flame sensor (3) is used to determine the burn intensity of a fuel in the combustion chamber (2). A controller (5) controls the one or more valves (11, 15, 17) to adjust the airflow through the one or more air supply paths (9, 14, 16) based on inputs from the flame and temperature sensors (3, 4).

13 Claims, 3 Drawing Sheets

(58) Field of Classification Search
USPC ..... 431/2, 75–84
See application file for complete search history.

(56) References Cited

U.S. PATENT DOCUMENTS 4,782,766 A * 11/1988 Lee ..... F23N 5/006
236/15 E
5,785,512 A * 7/1998 Cormier ..... F23N 5/082
431/12
6,984,122 B2 * 1/2006 Sullivan ..... F23N 1/022
431/89

* cited by examiner

STOVE, CONTROL SYSTEM, AND METHOD FOR CONTROLLING THE SAME

CROSS-REFERENCE TO EARLIER APPLICATION

This application is a § 371 National Stage Entry of PCT/GB2020/052506 filed Oct. 9, 2020 entitled "Stove, Control System, and Method for Controlling the Same," which application claims priority to GB Application No. 1915535.7 filed Oct. 25, 2019. The entire content of these applications is incorporated herein by reference in its entirety.

The present invention concerns a stove and a control system for controlling a stove. In particular, the present invention concerns wood burning or multi-fuel domestic stoves and a control system incorporated or for incorporation therein.

Wood burning and multi-fuel stoves have remained a popular method of heating homes. However, combustion of wood and mineral fuels results in the production of several unwanted by-products, such as carbon monoxide, smoke particles, NO, $NO_2$ and organic gaseous compounds. This has led to stove designs being refined over the years to try to maximise combustion efficiency and reduce the production of such unwanted by-products.

Many strategies to improve combustion efficiency have focussed on controlling the delivery of oxygen to different regions of the stove's combustion chamber. In this connection, a stove's primary airflow is delivered through inlets located at the base of the combustion chamber. This thereby feeds air up through the firebed, allowing for an intense main combustion stage. Nevertheless, a proportion of unburnt particles will remain suspended in the heated combustion gasses as smoke. One method for addressing this is to deliver a secondary airflow as a warmed stream of air for igniting any unburnt particles prior to their exhaustion from the stove. This secondary airflow may also be directed over the inner face of the stove's door as an air wash for keeping a stove's glass window clean. In some stove designs, a further air supply is provided to deliver a tertiary airflow from the rear of the combustion chamber to its upper region above the firebed. This is commonly achieved by forming apertures in a firebrick at the back of the combustion chamber, with the additional delivered oxygen enhancing combustion of smoke particles in the heated combustion gases collected at the top of the chamber.

Despite the above designs, however, there remains a need for further improvements to enhance combustion efficiency and reduce the quantity of carbon monoxide, smoke particles, NO, $NO_2$ and organic gaseous compounds generated. The present invention therefore seeks to offer solutions to this problem.

According to a first aspect of the present invention there is provided a stove having a combustion chamber supplied by one or more air supply paths, the stove comprising: one or more valves for controlling airflow through the one or more air supply paths; a controller for controlling the one or more valves for adjusting the airflow through the one or more air supply paths; a temperature sensor for determining the air temperature associated with the combustion chamber; and a flame sensor for determining the burn intensity of a fuel in the combustion chamber, wherein the controller controls the one or more valves based on inputs from the flame and temperature sensors.

In this way, the present invention allows the airflow feeding the combustion process to be controlled to optimise the stoichiometric balance for maximising combustion efficiency and minimising the CO, NO, $NO_2$, OGC and smoke particle emissions, throughout the combustion process. Importantly, by using feedback from the flame and temperature sensors, the controller is able to account for the airflow requirements at different stages of the combustion process. This contrasts with conventional control systems that, whilst able to regulate the air supply for limiting the combustion rate during peak stages, are not able to optimise the overall air supply, or the balance of different air supplies, across the combustion cycle.

Preferably, the flame sensor is an infrared sensor.

Preferably, the flame sensor comprises a transmission element for transmitting radiation from inside the combustion chamber to an electronic sensor component outside the combustion chamber. In this way, the transmission element allows the flame sensor to be separated from the combustion chamber, thereby protecting the sensor from the combustion heat that may otherwise damage it.

Preferably, the transmission element comprises a glass rod. In this way, the transmission element is able to achieve a high heat resistance, whilst being relatively inexpensive.

Preferably, the glass rod is mounted to a firebrick within an interior of the combustion chamber. In this way, the glass rod may be easily secured within the combustion chamber for receiving infrared radiation.

Preferably, the temperature sensor is a thermocouple. In this way, a signal indicating the temperature within the combustion chamber can be obtained inexpensively.

Preferably, the one or more valves comprise one or more motors operable for adjusting the airflow through the one or more air supply paths.

Preferably, each of the one or more air supply paths comprises a valve for adjusting the airflow through the respective air supply paths. In this way, each of the air supply paths may be independently regulated.

Preferably, the stove further comprised one or more air inlets for supplying the one or more air supply paths.

Preferably, the controller comprises logic for adjusting the airflow through the one or more air supply paths to maintain the stoichiometric balance within an optimised range for combustion based on the sensed burn intensity and combustion chamber temperature.

Preferably, the stove further comprises a door switch for detecting when the stove door is opened or closed, and wherein the controller further controls the one or more valves based on inputs from door switch. In this way, the opening and closing of the door may be used as a trigger to indicate that fresh fuel has been loaded. In preferred embodiments, when the door state changes from closed to open, the controller may run a calibration check to ensure that the valves are working properly and that their opening/closing state corresponds to the state identified by the controller's logic. When the door is subsequently closed, the controller may then go to a "Lighting" stage in which the valves are controlled in a manner to promote the ignition of the fuel. The controller may then check that the required fire intensity and temperature has been reached through the "Early Burn" stage, followed by the "Steady State" and "Char" stages. In embodiments, whenever a "door closed" trigger signal is received, the controller may initiate the "Lighting" stage, which then enables the program cycle to begin again. The controller may switch to other stages if lighting is not successful, as determined by the fire intensity and temperature inputs. Importantly, during the Steady State and Char stages, the air requirement is lower (particularly in Char) so the valves can be more closed for increasing efficiency.

However, when fresh fuel has been loaded, the provision of the door switch input allows the controller to operate the valves to revive the fire from the char stage. As such, the valves may be opened to deliver sufficient air for igniting the fuel quickly and preventing the fresh fuel from producing smoke.

Preferably, the logic further maintains the stoichiometric balance within an optimised range for combustion based on the stage of combustion, as determined to have begun with a sensed door opening or closing event.

Preferably, the stove is a wood burning or multifuel stove.

In embodiments, there may also be a temperature sensor to determine the room or boiler temperature in order to determine the level of heating that is required.

According to a second aspect of the present invention there is provided a controller for a stove having a combustion chamber, the controller comprising: one or more outputs for controlling one or more valves to adjust airflow through one or more air supply paths supplying the combustion chamber; a temperature sensor input for receiving a signal indicating the air temperature associated with the combustion chamber; and a flame sensor input for receiving a signal indicating the burn intensity of a fuel in the combustion chamber; wherein the controller controls the one or more valves based on inputs from the flame and temperature sensors.

According to a third aspect of the present invention there is provided a method of controlling a stove having a combustion chamber, comprising the steps of: receiving a temperature sensor input indicating the air temperature in the combustion chamber; receiving a flame sensor input indicating the burn intensity of a fuel in the combustion chamber; controlling one or more valves provided in one or more air supply paths supplying the combustion chamber for adjusting the airflow for maintaining the stoichiometric balance within an optimised range for combustion based on the sensed burn intensity and combustion chamber temperature.

Illustrative embodiments of the present invention will now be described with reference to the accompanying drawings in which.

Figure 1:
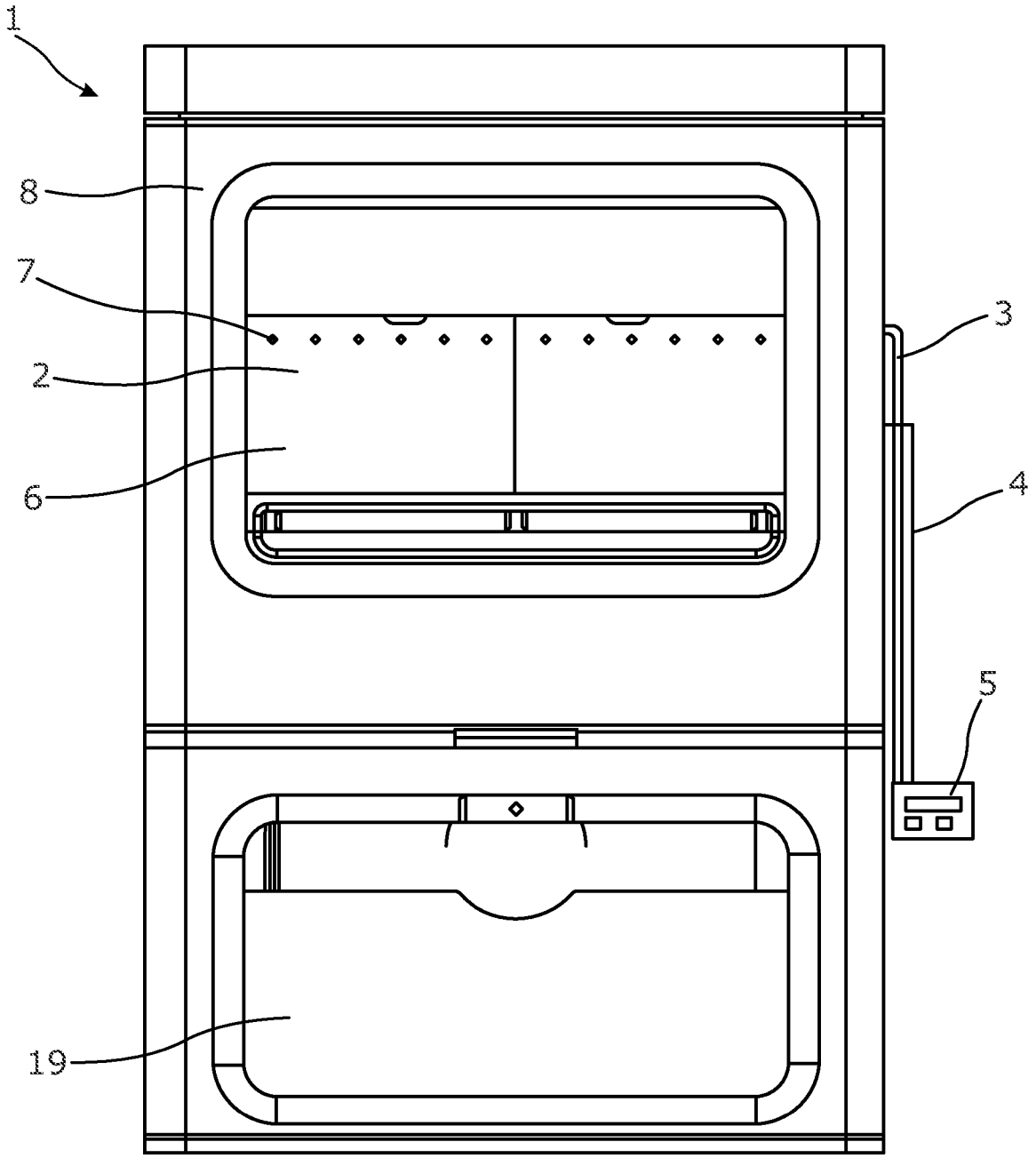
FIG. 1 shows a front view of a stove according to an embodiment of the present invention.
Figure 2:
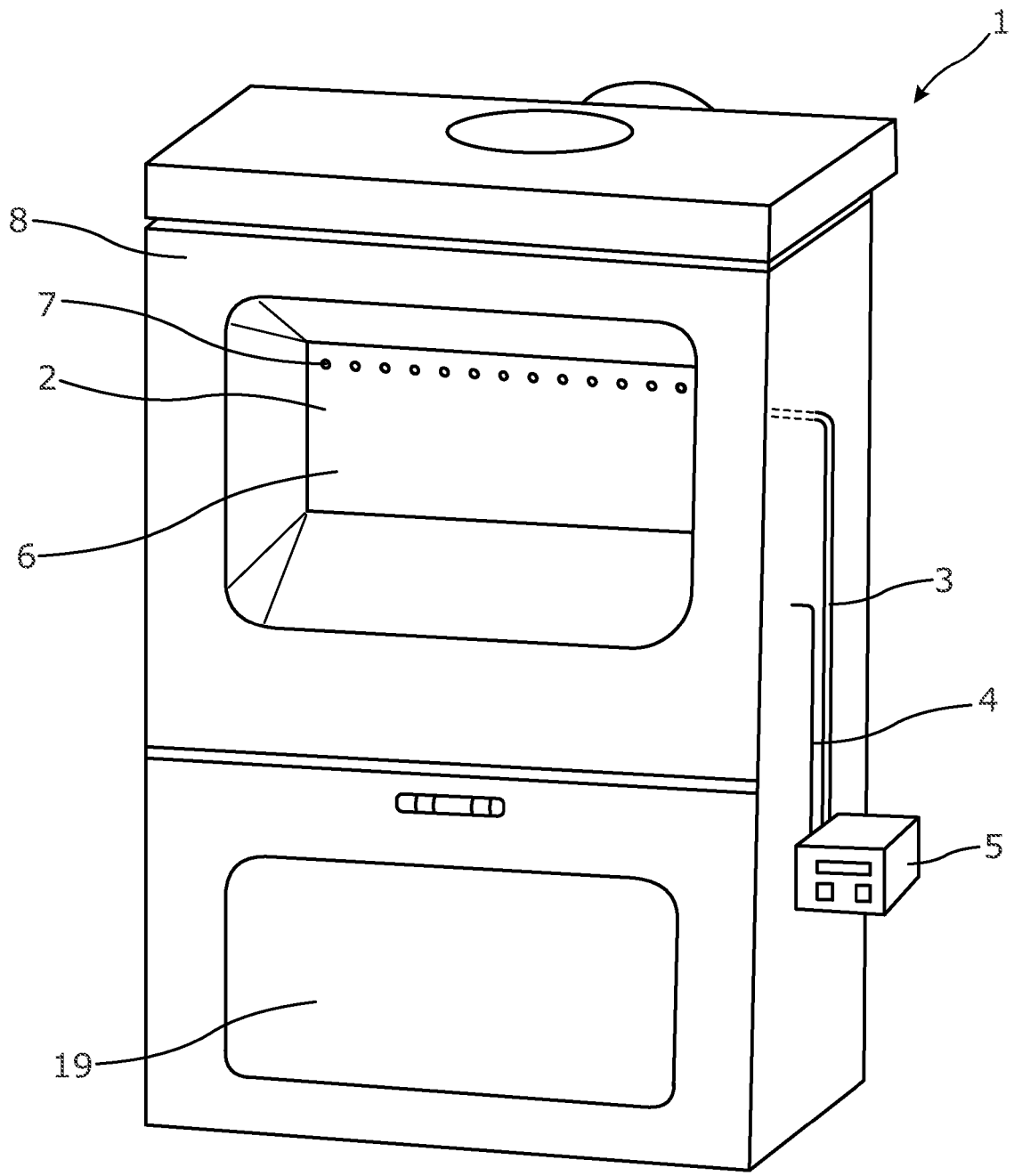
FIG. 2 shows a perspective view of the stove shown in FIG. 1.

FIGS. 1 and 2 show front and perspective views of a stove 1 according to an embodiment of the present invention. The stove 1 comprises a combustion chamber 2 enclosed by door 8 and supported above a fuel store 19. In use, a user may take fuel, such as wood, from the fuel store 19 and place it within the combustion chamber 2 where it can be burnt to generate heat.

The combustion chamber 2 comprises a firebrick 6 located at the rear of the stove 1. The front of the firebrick 1 faces the combustion chamber 2 and has a plurality of tertiary air inlets 7 provided in a linear array across the width of the firebrick 1 towards the top of the combustion chamber 2.

At the right side of the exterior of the stove 1 is micro-controller 5. In this embodiment, the micro-controller 5 comprises a display and input buttons for controlling the stove's operation, as will be discussed in further detail below. In simplified embodiments the micro-controller 5 may be provided as a basic logic circuit without user inputs. In other embodiments, the micro-controller 5 may be provided as a processor with programmable logic controllable remotely by, for example, a user's smart phone or remote control. In other embodiments the controller may be situated below the fire chamber in a cool region within the structure.

Micro-controller 5 receives sensor inputs from thermocouple 4 and transmission rod 3 which connect into the combustion chamber 2.

The thermocouple 4 provides a temperature sensor to allow the micro-controller to determine the air temperature associated with the combustion chamber. In this way, the temperature sensor provides a feedback signal indicating the air temperature in or near to the combustion chamber.

The transmission rod 3 is formed of glass and functions to transmit infrared radiation emitted from within the combustion chamber 2 to an infrared radiation sensor component connected to the distal end of the rod 3 and housed together with the micro-controller 5. In this way, the transmission rod 3 allows the infrared sensor to be kept cool enough to prevent damage to the sensor.

The transmission rod 5 and infrared radiation sensor provide a flame sensor input for the micro-controller. That is, the level of infrared radiation detected indicates the burn intensity of fuel within the combustion chamber 2. Consequently, the output from the infrared sensor also provides a metric indicative of the rate of particulate emissions.

The stove door 8 further comprises a door switch (not shown) connected to the micro-controller 5 for generating a signal identifying when the door is opened or closed.

Figure 3:
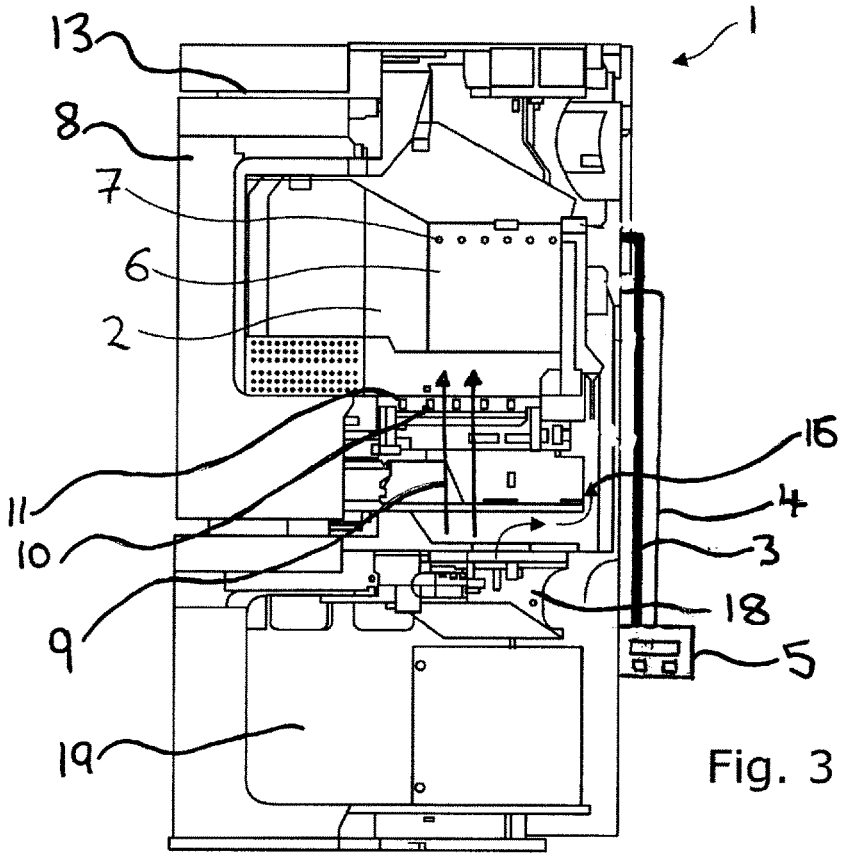
FIG. 3 shows a partial cutaway front view of the stove shown in FIGS. 1 and 2.
Figure 4:
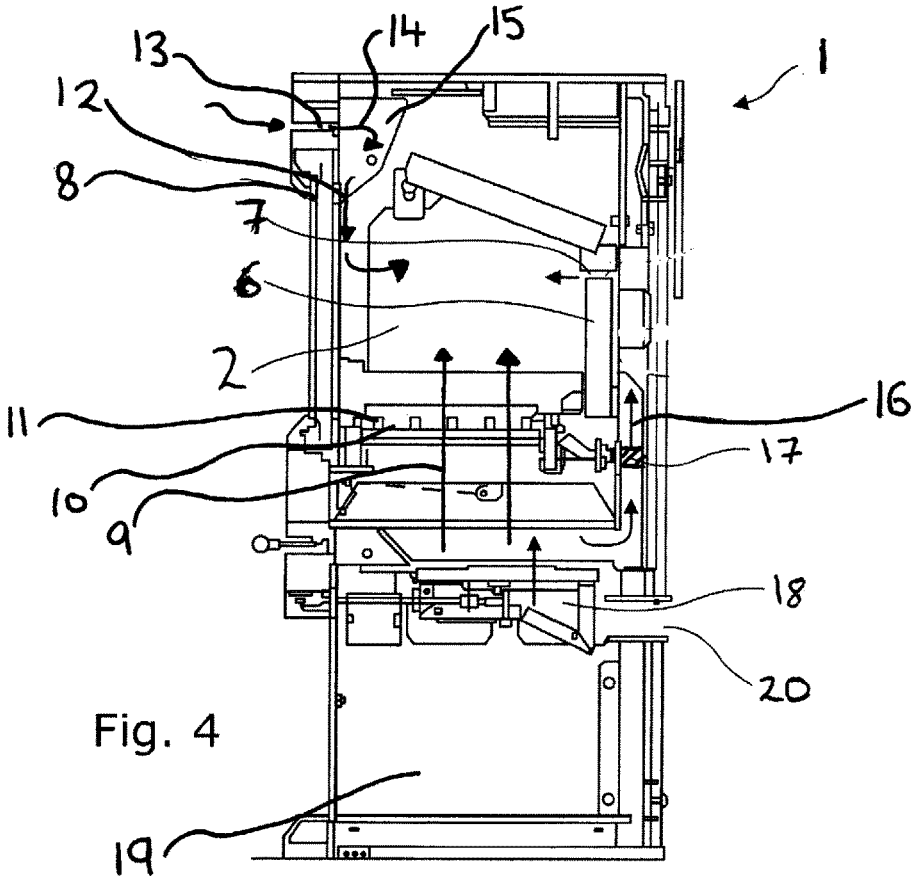
FIG. 4 shows a cross-sectional side view of the stove shown in FIGS. 1, 2 and 3.

The stove shown in FIGS. 1 and 2 is further described in reference to FIGS. 3 and 4. FIG. 3 shows a partial cutaway front view and FIG. 4 shows a cross-sectional side view.

As shown best in FIG. 4, the combustion chamber 2 is provided as a cavity within the stove interior, with rear firebrick 6 provided at the back and the stove door 8 at the front. The base of combustion chamber 2 provides a platform onto which the sold fuel, such as wood, is placed for combustion. The combustion chamber is fed by primary, secondary and tertiary air supply pathways 9, 14, and 16.

The primary airflow pathway 9 feeds in from the main air intake 20, through manifold 18 and up through primary inlets 10 in the base of the combustion chamber 2. The size of the apertures of primary inlets 10 can be adjusted using valves 11 driven by an actuator under the control of micro-controller 5. In this embodiment, the actuator is a stepper motor.

The secondary airflow pathway 14 feeds in from secondary inlet 13 on the upper front face of the stove 1. Valve 15 allows the flow of air through the secondary inlet 13 to be controlled by micro-controller 5 using an actuator. The secondary airflow 14 is delivered as a stream of air that is warmed as it first flows down the face of door 8 and then into the centre of the combustion chamber 2 for igniting unburnt particles prior to their exhaustion from the stove.

The tertiary airflow pathway 16 is fed from manifold connected to the main air intake 19. The tertiary airflow pathway 16 passes up a channel in the rear of the stove 1 to the rear of the firebrick 6, where it passes out into the combustion chamber 2 through the horizontal array of tertiary apertures 7. Tertiary valve 17 is provided in the tertiary airflow pathway 16 for controlling the flow rate of air delivered out through the tertiary apertures 7. The tertiary valve 17 is driven by an actuator under the control of micro-controller 5. The airflow delivered through tertiary apertures 7 acts to enhance combustion of smoke particles in the heated combustion gases collected at the top of the combustion chamber 2.

In use, a user opens door 8 and loads the base of the combustion chamber 2 with a quantity of fuel. The user then ignites the fuel and closes the door 8. The micro-controller 5 detects the opening and closing of the stove door 8 by detecting the signal generated by the switch. This initiates to the micro-controller 5 to commence a control sequence for controlling the airflows through the primary, secondary and tertiary airflow pathways 9, 14, 16 as the fuel moves through the combustion process. In embodiments, the micro-controller 5 may also allow a user to input a desired heating temperature and the micro-controller 5 will regulate the airflows with the primary, secondary, and tertiary valves 11, 15, and 17 accordingly Control operations by the micro-controller 5 are based on feedback information provided from the thermocouple 4 and transmission rod/infrared sensor 3 indicating combustion temperature and burn intensity.

In this connection, when the quantity of fuel is ignited, it progresses through a combustion process. Initially, the combustion chamber 2 and fuel are cold, and hence the igniting flame acts to heat a region of the fuel and thereby promote moisture evaporation and to release combustible gasses. Once these released gasses ignite, the combustion process enters a flaming stage where the ignited fuel combusts and the released gasses also ignite. Finally, the flaming stage gives way to a char stage, characterised by the loss of flame, where the fuel burns slowly without flame or smoke. The primary valve 11, the secondary valve 15, and the tertiary valve 17 may be opened differing amounts in order to optimise efficiency and minimise emissions in the different stages of combustion. As such, the airflow pathways are regulated to enhance heating within the combustion chamber 2.

Once the combustion chamber 2 and fuel has reached a sufficiently high temperature, the fuel is able to undergo more complete combustion. In this state, the heat acts to release combustible gasses more uniformly from the fuel, and those released gasses subsequently undergo more complete combustion. At this stage the primary valve 11, the secondary valve 15 and the tertiary valve 17 may be varied to promote uniform combustion. Alternatively, the valves may not be fully opened and may instead be controlled by the micro-controller 5 to regulate the airflow pathways in order to achieve a desired maximum temperature. That is, the airflow to the combustion chamber 2 may be partially restricted to produce a lower heating level.

At the end stages of the combustion process, the residual heat within the combustion chamber 2 remains high. However, the fuel has been nearly entirely consumed and the flames begin to subside. The micro-controller 5 is able to determine the onset of this stage from the infrared radiation transmitted through transmission rod 3. In response, the micro-controller 5 may begin to vary the airflow rates through the airflow pathways in order to promote the most efficient combustion, with least emissions.

Furthermore, when fresh fuel is loaded during the combustion process, the controller can detect this through actuation of the door switch. In response, the controller can operate the valves to open further. This may thereby facilitate the revival of the fire from the Steady State or Char stages of combustion, where the air requirements are lower. As such, sufficient air can be delivered for igniting the fresh fuel quickly and preventing it from producing smoke.

As such, the present invention allows the airflow feeding the combustion process to be controlled based on feedback from the flame and temperature sensors to thereby optimise the stoichiometric balance throughout the combustion process. This helps to maximise combustion efficiency and minimise the quantity of unburnt particulates, CO, NO, $NO_2$ and OGC produced.

It will be understood that the embodiment illustrated above shows applications of the invention only for the purposes of illustration. In practice the invention may be applied to many different configurations, the detailed embodiments being straightforward for those skilled in the art to implement.

For example, the actuators used to actuate the valves for controlling the airflow pathways may be housed outside the main stove body in an external housing. As such, the valves may be driven through linkage mechanisms connecting between the valves and the actuators in the external housing.

Furthermore, although the above illustrative embodiment employs a door switch which is actuated with operation of the door, it will be understood that other means for detecting the loading of fresh fuel may be used. For example, the stove may comprise a user operated button for indicating fuel has been loaded.

The invention claimed is:

1. A stove having a combustion chamber supplied by one or more air supply paths, the stove comprising:

one or more valves for controlling airflow through the one or more air supply paths;

a controller for controlling the one or more valves for adjusting the airflow through the one or more air supply paths;

a temperature sensor for determining the air temperature associated with the combustion chamber; and a flame sensor for determining the burn intensity of a fuel in the combustion chamber;

wherein the controller controls the one or more valves based on inputs from the flame and temperature sensor;

wherein the controller comprises logic for adjusting the airflow through the one or more air supply paths to maintain the stoichiometric balance within an optimised range for combustion based on the sensed burn intensity and combustion chamber temperature; and wherein the logic further maintains the stoichiometric balance within an optimised range for combustion based on the stage of combustion, as determined to have begun with a sensed door opening or closing event.

2. A stove according to claim 1, wherein the temperature sensor is a thermocouple.

3. A stove according to claim 1, wherein the one or more valves comprise one or more motors operable for adjusting the airflow through the one or more air supply paths.

4. A stove according to claim 1, wherein each of the one or more air supply paths comprises a valve for adjusting the airflow through the respective air supply paths.

5. A stove according to claim 1, further comprising one or more air inlets for supplying the one or more air supply paths.

6. A stove according to claim 1, wherein the stove is a wood burning or multifuel stove.

7. A stove according to claim 1, wherein the flame sensor is an infrared sensor.

8. A stove according to claim 1, wherein the flame sensor comprises a transmission element for transmitting radiation from inside the combustion chamber to an electronic sensor component outside the combustion chamber.

9. A stove according to claim 8, wherein the transmission element comprises a glass rod.

10. A stove according to claim 9, wherein the glass rod is mounted to a firebrick within an interior of the combustion chamber.

11. A stove having a combustion chamber supplied by one or more air supply paths, the stove comprising:

one or more valves for controlling airflow through the one or more air supply paths;

a controller for controlling the one or more valves for adjusting the airflow through the one or more air supply paths;

a temperature sensor for determining the air temperature associated with the combustion chamber;

a flame sensor for determining the burn intensity of a fuel in the combustion chamber, wherein the controller controls the one or more valves based on inputs from the flame and temperature sensor;

a stove door; and a door switch for detecting when the stove door is opened or closed, wherein the controller further controls the one or more valves based on inputs from the door switch.

12. A controller for a stove having a combustion chamber, the controller comprising:

one or more outputs for controlling one or more valves to adjust airflow through one or more air supply paths supplying the combustion chamber;

a temperature sensor input for receiving a signal indicating the air temperature associated with the combustion chamber; and a flame sensor input for receiving a signal indicating a burn intensity of a fuel in the combustion chamber;

wherein the controller is configured to:

control the one or more valves based on inputs from the flame and temperature sensors;

adjust the airflow through the one or more air supply paths to maintain a stoichiometric balance within an optimised range for combustion based on the sensed burn intensity and combustion chamber temperature; and maintain the stoichiometric balance within an optimised range for combustion based on the stage of combustion, as determined to have begun with a sensed door opening or closing event.

13. A method of controlling a stove having a combustion chamber, comprising the steps of:

receiving a temperature sensor input indicating an air temperature in the combustion chamber, receiving a flame sensor input indicating a burn intensity of a fuel in the combustion chamber;

controlling one or more valves provided in one or more air supply paths supplying the combustion chamber for adjusting the airflow for maintaining a stoichiometric balance within an optimised range for combustion based on the sensed burn intensity and combustion chamber temperature; and maintaining the stoichiometric balance within an optimised range for combustion based on the stage of combustion, as determined to have begun with a sensed door opening or closing event.

* * * * *